US005240592A

United States Patent [19]

Meyer et al.

[11] Patent Number: 5,240,592

[45] Date of Patent: Aug. 31, 1993

[54] METHOD FOR REFINING COAL UTILIZING SHORT RESIDENCE TIME HYDROCRACKING WITH SELECTIVE CONDENSATION TO PRODUCE A SLATE OF VALUE-ADDED CO-PRODUCTS

[75] Inventors: Lee G. Meyer; Gerald F. Cavaliere, both of Englewood, Colo.

[73] Assignee: Carbon Fuels Corporation, Englewood, Colo.

[21] Appl. No.: 709,747

[22] Filed: Jun. 4, 1991

Related U.S. Application Data

[63] Continuation-in-part of Ser. No. 355,528, May 23, 1989, Pat. No. 5,021,148, and a continuation-in-part of Ser. No. 277,603, Nov. 28, 1988, Pat. No. 4,938,782, and a continuation-in-part of Ser. No. 84,270, Aug. 11, 1987, Pat. No. 4,787,915, and a continuation-in-part of Ser. No. 59,288, Jun. 8, 1987, Pat. No. 4,832,831, and a continuation-in-part of Ser. No. 59,289, Jun. 8, 1987, Pat. No. 4,842,615, and a continuation-in-part of Ser. No. 658,880, Oct. 9, 1984, Pat. No. 4,685,936, and a continuation-in-part of Ser. No. 658,878, Oct. 9, 1984, Pat. No. 4,671,800, which is a continuation-in-part of Ser. No. 427,937, Sep. 29, 1982, Pat. No. 4,475,924, which is a continuation-in-part of Ser. No. 247,382, Mar. 24, 1981, abandoned.

[51] Int. Cl.[5] ..... C10G 1/00

[52] U.S. Cl. ..... 208/431; 208/433; 208/403; 44/282

[58] Field of Search ..... 208/403, 415, 431, 433; 44/281, 282

[56] References Cited

U.S. PATENT DOCUMENTS 5,021,148 6/1991 Meyer et al. ..... 208/433

*Primary Examiner*—Theodore Morris
*Assistant Examiner*—Walter D. Griffin
*Attorney, Agent, or Firm*—Lee G. Meyer

[57] ABSTRACT

This invention generally relates to refining coal by fluidized hydrocracking employing short residence time volatilization and decomposition of the coal feedstock, with subsequent selective condensation and hydrostabilization without utilization of external hydrogen, that is, hydrogen other than that contained in the coal feedstock, to maximize oil yield and minimize char and gas production. The invention more particularly relates to an improved method of economically producing uniform, fluidic, oil-type transportable fuel systems and fuel compositions and a slate of "value-added" co-products by a coal refining process employing short residence time hydrodisproportionation (SRT-HDP).

20 Claims, 2 Drawing Sheets

METHOD FOR REFINING COAL UTILIZING SHORT RESIDENCE TIME HYDROCRACKING WITH SELECTIVE CONDENSATION TO PRODUCE A SLATE OF VALUE-ADDED CO-PRODUCTS

TECHNICAL FIELD

This application is a continuation-in-part of U.S. patent application Ser. No. 355, 528 filed May 23, 1989, now U.S. Pat. No. 5,021,148 issued Jun. 4, 1991, and of its parent Ser. No. 277,603 filed Nov. 28, 1988 now U.S. Pat. No. 4,938,782 issued Jul. 3, 1990, and of its parent U.S. patent application Ser. No. 084,270 filed Aug. 11, 1987 now U.S. Pat. No. 4,787,915 issued Nov. 29, 1988, and of its parent U.S. patent application Ser. No. 059,288 filed Jun. 8, 1987, now U.S. Pat. No. 4,832,831, and U.S. patent application Ser. No. 059,289 filed Jun. 8, 1987, now U.S. Pat. No. 4,842,615, and of their parents, U.S. patent application Ser. No. 658,880 filed Oct. 9, 1984 now U.S. Pat. No. 4,685,936 issued Aug. 11, 1987, and U.S. patent application Ser. No. 658,878 also filed Oct. 9, 1984, now U.S. Pat. No. 4,671,800 issued Jun. 9, 1987 both of which are continuations-in-part of U.S. patent application Ser. No. 427,937 filed Sep. 29, 1982, now U.S. Pat. No. 4,475,924 issued Oct. 9, 1984 which is a continuation-in-part of U.S. patent application Ser. No. 247,382 filed Mar. 24, 1981, now abandoned.

These parent, grandparent, great-grandparent, and great-great-grandparent applications, which are incorporated in their entirety by reference as if they were completely set out herein, disclose a pipeline transportable fuel system as well as non-polluting, fluidic, completely combustible, pipeline transportable fuel compositions derived from coal, which compositions contain particulate coal char admixed with liquids obtained from pyrolysis, hydropyrolysis, and/or short residence time volatilization of coal with subsequent hydrogenation; and methods for making such a system and fuel compositions. The parental lineage applications further disclose that the process method can be altered to vary the product and co-product distribution as well as the rheological characteristics of the fuel system. The parental lineage applications also disclose that the method of processing the coal, and specifically hydrogen rearrangement or "hydrodisproportionation" (thermal hydrocracking), is important in determining both the economics of the process and the product slate. The immediate parent is concerned with partial liquefaction using short residence time hydrodisproportionation (SRT-HDP).

The grandparent applications relate to volatilization of coal to produce char and liquid co-products without utilization of external hydrogen, i.e., hydrogen other than that contained in the coal feedstock; and more particularly to an improved method of economically producing uniform, fluidic, oil-type transportable fuel systems and fuel compositions and a slate of "value-added" co-products by a coal refining process employing short residence time, high heating rate hydrodisproportionation.

The instant application relates to an improvement in the coal refining process using thermal hydrocracking techniques by employing selective condensation of volatilization products prior to or concurrent with hydrogenation to minimize char production and gas formation while maximizing hydrocarbon liquid formation and carbon conversion.

BACKGROUND ART

Coal is the world's most abundant fossil fuel. However, coal has three major drawbacks: (1) Coal is a solid and is less easily handled and transported than fluidic or gaseous materials; (2) Coal contains compounds which, on burning, produce "air toxics" and the pollutants associated with acid rain; and (3) Coal is not a uniform fuel product, varying in characteristics from region to region and from mine to mine.

In fossil fuels, the ratio of hydrogen atoms to carbon atoms is most important in determining the heating value per unit weight. The higher the hydrogen content, the more liquid (or gaseous) the fuel, and the greater its heat value. Natural gas, or methane, has a hydrogen-to-carbon ratio of 4 to 1 (this is the maximum); gasoline has a ratio of almost 2.2 to 1; petroleum crude about 2.0 to 1; shale oil about 1.5 to 1; and coal about 1 to 1. Thus, if the hydrogens on half the carbons could be transferred or "rearranged" to the other half of the carbons, then the result would be half the carbons with 0 hydrogens and half with 2 hydrogens. The first portion of carbons (with 0 hydrogens) is char; the second portion of carbons (with 2 hydrogens) is a liquid product similar to a petroleum fuel oil. If this could be accomplished using only hydrogen inherent in the coal, i.e., no external hydrogen source, then the coal could be refined in the same economical manner as petroleum, yielding a slate of refined hydrocarbon products and char.

In our modern society almost every raw material is refined prior to use. Various raw ores are refined to produce useful products, such as aluminum, copper, silver, titanium, and tungsten. Except for coal, all of our fuels are refined: uranium ore, crude oil, and natural gas are refined.

Natural gas, as it comes out of the ground, contains impurities, such as $CO_2$, heavy hydrocarbons, and sulfur containing gases. These impurities are refined out prior to use to yield predominantly a single hydrocarbon compound: methane. Natural gas represents less than 3% of the United States' known energy reserves.

Crude oil, as it comes from the ground, has limited utility. It is a dirty, sulfur-containing fuel. Hence, the petroleum industry has developed refining processes using hydrocracking techniques to produce value-added products, such as gasoline, jet fuel, and other hydrocarbon fuels and petrochemicals. Thus, gasoline refined from high sulfur crude or from light Arabian crude is still gasoline. Most of the world's crude oil reserves are remote from population centers and must be imported by industrialized nations.

Raw coal, as it comes from the ground, also has limited utility. Like its "kissing cousin", crude oil, coal contains complex hydrocarbons, sulfur, and nitrogen. High sulfur bituminous coals and high moisture subbituminous coals are very different raw materials and cannot be interchanged as fuels. Coal is our country's most abundant fossil fuel, accounting for over 95% of our fossil energy reserves. The United States has 43% more energy in coal reserves than the energy equivalent of all the oil and gas in known reserves in the whole world. Vast deposits of coal also exist in Eastern Europe, Russia, and China but are either far away from manufacturing regions or contain high levels of pollutants in proportion to the heat value of the coal.

The lignites, peats, and lower calorific value subbituminous coals have not had wide-spread use. This is due primarily to the cost of transporting a lower Btu product as well as to the danger of spontaneous combustion because of the high content of volatile matter and high percentage of moisture which is characteristic of such coals.

Since low-rank coals contain high percentages of volatile matter, the risk of spontaneous combustion is increased by dehydration, even by the non-evaporation methods. Therefore, in order to secure stability of the dehydrated coal in storage and transportation, it has been necessary to cover the coal with an atmosphere of inert gas such as nitrogen or combustion product gas, or to coat it with crude oil so as not to reduce its efficiency as a fuel. However, these methods are not economical.

The inefficient and expensive handling, transportation and storage of coal (primarily because it is a solid material) makes coal not economically exportable and the conversion of oil-fired systems to coal less economically attractive. Liquids are much more easily handled, transported, stored and fired into boilers.

In addition, coal is not a heterogeneous fuel, i.e, coal from different reserves has a wide range of characteristics. It is not, therefore, a uniform fuel of consistent quality. Coal from one region (or even of a particular mine) cannot be efficiently combusted in boilers designed for coal from another source. Boilers and pollution control equipment must either be tailored to a specific coal or configured to burn a wide variety of material with a loss in efficiency.

The transportation and non-uniformity problems are compounded by the presence of potential pollutants in raw coal. Sulfur compounds and nitrogen compounds inherent in the coal, upon combustion, create pollutants which are thought to cause acid rain. The sulfur compounds are of two types, organic and inorganic (pyritic), both of which produce $SO_x$. The fuel bound nitrogen, i.e., organic nitrogen in the coal, combusts to form $NO_x$. Further, because of the nonuniformity of coal, it combusts with "hot spots". Some of the nitrogen in the combustive air (air is 75% nitrogen by weight) is oxidized to produce $NO_x$ as a result of the elevated atmospheric temperatures created by these "hot spots". This so-called "thermal $NO_x$" has heretofore only been reduced by expensive boiler modification systems.

Raw coal cleaning has heretofore been available to remove inorganic ash and pyritic sulfur but is unable to remove the organic sulfur and nitrogen compounds. Fluidized bed boilers, which require limestone as an $SO_x$ reactant, and scrubbers or $NO_x$ selective catalytic convertors (so-called combustion, and post-combustion clean air technologies) have been the conventional technologies for alleviating these pollution problems. These devices are tremendously expensive from both capital and operating standpoints, adding to the cost of power. This added power cost not only increases the cost of manufactured goods, but also ultimately diminishes domestic competitiveness with foreign goods. Further, these devices reduce power plant efficiency since they draw on power which would otherwise be available for sale. This inefficiency results in increased $CO_2$ emissions per unit of power sold. Carbon dioxide production has been linked by some with the "greenhouse" effect, i.e. the heating of the atmosphere.

It would, therefore, be advantageous to clean up the coal by removing the organic nitrogen (fuel nitrogen), as well as the organic sulfur while providing a uniform fuel with high reactivity and lower flame temperature to reduce the thermal $NO_x$. The coal refining process, like the petroleum refining process, employs thermal hydrocracking of the complex hydrocarbons in the raw fossil fuel to produce char (coke) and liquid product. Process gases are recycled to avoid the need for external hydrogen. Hydrocracking involves the thermal breaking or "cracking" of larger hydrocarbon molecules in the feedstock and subsequent hydrogenation of the molecular pieces using hydrogen derived from the feedstock. In coal refining, inherent moisture is another source of hydrogen. In both coal and oil refining processes, sulfur and nitrogen are removed during hydrocracking. The rearrangement of hydrogen within the coal molecule, so-called "hydrodisproportionation", produces a slate of clean, value-added co-products, just as is done with crude oil in a petroleum refining process. The coal refining process is most analogous to the commercial hydrocracking of heavy crudes, bitumen or "tar sands".

In order to overcome some of the inherent problems with coal, previous technologies have attempted to convert coal to synthetic liquid or gaseous fuels. These "synfuel" processes are capital intensive and require a great deal of externally supplied water and external hydrogen, i.e., water and hydrogen derived from other than the coal feedstock. Additionally, some of these processes produce large quantities of $CO_2$, a "greenhouse gas". The processes are also energy intensive in that most carbon atoms in the coal matrix are converted to hydrocarbons, i.e., no char. The liquefaction of coal involves hydrogenation using external hydrogen. This differs markedly from merely "rearranging" existing hydrogen in the coal molecule as in hydrodisproportionation.

Volatilization Processes

Coal pyrolysis is a well-known process whereby coal is thermally partially devolatilized by slowly heating the coal out of contact with air. Different pyrolysis products may be produced by varying the conditions of temperature, pressure, atmosphere, and/or material feed. Traditional pyrolysis produces very heavy hydrocarbon tars and carbon (char), with hydrogen being liberated, not utilized.

In prior art pyrolysis, as shown in FIG. 2, the coal is heated at lower heating rates and long residence times such that the solid organic material (the coal molecule) undergoes a slow decomposition at reaction rate $k_1$ to yield "decomposition" products, primarily free radical hydrocarbon pieces or fragments. These "decomposition" products undergo a rapid recomposition or "condensation" reaction at reaction rate $k_2$. The condensation reaction produces char and dehydrogenated hydrocarbons, thus liberating hydrogen and heavy (tarry) liquids. The uncontrolled decomposition reaction is not desirable in a refining type process because it liberates hydrogen (instead of conserving it) and produces heavy material and char. As shown in FIG. 2, when $k_1$ (relatively slow reaction rate) and $k_2$ (relatively more rapid reaction rate) overlap, the dehydrogenation of the decomposition product, i.e., condensation reaction, is predominant. Because it is believed that unless the decomposition reaction take place rapidly ($k_1$ is large), this reaction and the condensation reaction will take place within the particle where little hydrogen is present to effect the hydrogenation reaction.

Hydropyrolysis of coal to produce char and pyrolysis liquids and gases from bituminous and subbituminous coals of various ranks attempted to add external hydrogen such that decomposition products would be hydrogenated. These processes have been carried out in both the liquid and gaseous phases. The most economical processes, which employ milder conditions similar to pyrolysis, have had only limited success. Without rapid heating rates, the decomposition material remains inside the particles and thus cannot be hydrogenated by external hydrogen. In order to promote hydrogenation, more stringent reaction conditions were required, reducing the economic viability. Examples of such processes are disclosed in U.S. Pat. Nos. 4,704,134; 4,702,747; and 4,475,924. In such processes, coal is heated in the presence of hydrogen or a hydrogen donating material to produce a carbonaceous component called char and various hydrocarbon-containing oil and gas components. Many hydropyrolysis processes employ externally generated additional hydrogen which substantially increases the processing cost and effectively makes the process a "liquefaction" process.

A particular type of coal hydropyrolysis, flash hydropyrolysis, is characterized by a very short reactor residence time of the coal. In short residence time (SRT) processes, feedstock molecules are volatilized so that hydrocarbon fragments can be hydrogenated. These processes are advantageous in that the capital costs are reduced because the feedstock throughput is so high. In SRT processes, high quality heat sources are required to effect the transformation of coal to char, liquids and gases. However, these higher heating rates tend to thermally hydrocrack and gasify the material at lower pressures. This gasification reduces the yield of valuable liquids and available hydrogen and adversely affects process economics.

U.S. Pat. No. 3,960,700 to Rosen describes a process for exposing coal to high heat for short periods of time to maximize the production of desirable hydrocarbons.

In U.S. Pat. Nos. 4,671,800 and 4,685,936 to Meyer et al., it is disclosed that coal can be volatilized under certain SRT conditions to produce a particulate char, gas and a liquid organic fraction. The liquid organic fraction is rich in hydrocarbons, is combustible, can be beneficiated and can serve as a liquid phase for a carbonaceous slurry fuel system. The co-product distribution, for example, BTX and naphtha, and the viscosity, pumpability and stability of the slurry when the char is admixed with the liquid organic fraction are functions of process and reaction parameters. The rheology of the slurry is a function of solids loading and sizing, oil viscosity, and the utilization of surfactants or other additives.

The economic feasibility of producing the slurry fuel and a slate of value-added co-products is predicated on the method of volatilizing the coal. The economics of transporting the slurry fuel is predicated upon the slurry's rheology.

Hydrogen Utilization

In many processes, hydrogen is oxidized either outside or within the reactor to generate high quality heat. However, the oxidation of hydrogen not only creates water but also reduces the hydrogen available to hydrogenate hydrocarbons to higher quality fuels. Thus, in prior art processes, either external hydrogen is required or the product is degraded because valuable hydrogen is converted to water.

The prior art methods of deriving hydrogen for hydropyrolysis are either by: (1) purchasing or generating external hydrogen, which is very expensive; (2) steammethane reforming followed by shift conversion and $CO_2$ removal as disclosed in a paper by J. J. Potter of Union Carbide; or (3) char gasification with oxygen and steam followed by shift conversion and $CO_2$ removal as disclosed in a paper by William J. Peterson of Cities Service Research and Development Company.

All three of these hydrogen production methods are expensive, and a high temperature heat source such as direct $O_2$ injection into the hydropyrolysis reactor is still required to volatilize the coal. In the prior art processes, either carbon (char) is gasified by partial oxidation such as in a Texaco gasifier (U.S. Pat. No. 4,491,456 to Schlinger and U.S. Pat. No. 4,490,156 to Marion et al.), or oxygen was injected directly into the reactor. One such system is disclosed in U.S. Pat. No. 4,415,431 (1983) to Matyas et al. When oxygen is injected directly into the reactor, it preferentially combines with hydrogen to form heat and water, using up hydrogen which is then unavailable to upgrade the hydrocarbons. The water must be removed from the reactor product stream. Additionally, the slate of hydrocarbon co-products is limited.

Thus, it would be advantageous to have a means for producing: (1) a high-quality heat for volatilization, (2) hydrogen, and (3) other reducing gases prior to the reaction zone without producing large quantities of water and without using up valuable hydrogen.

Volatilization Reactors

Common volatilization reactors include the fluidized bed reactor which uses an upward flow of reactant gases at a sufficient velocity to overcome the gravitational forces on the carbonaceous particles, thereby causing movement of the particles in a gaseous suspension. The fluidized bed reactor is characterized by large volumes of particles accompanied by long, high-temperature exposure times to obtain conversion into liquid and gaseous hydrocarbons.

Another common reactor is the entrained flow reactor which utilizes a high-velocity stream of reactant gases to impinge upon and carry the carbonaceous particles through the reactor vessel. Entrained flow reactors are characterized by smaller volumes of particles and shorter exposure times to the high-temperature gases. Thus, these reactors are useful for SRT-type systems.

In one prior art two-stage entrained flow reactor, a first stage is used to react carbonaceous char with a gaseous stream of oxygen and steam to produce hydrogen, oxides of carbon, and water. These products continue into the second stage where volatile-containing carbonaceous material is fed into the stream. The carbonaceous feed reacts with the first-stage gas stream to produce liquid and gaseous hydrocarbons, including large amounts of methane gas and char.

Prior art two-stage processes for the gasification of coal to produce primarily gaseous hydrocarbons include U.S. Pat. Nos. 4,278,445 to Stickler; 4,278,446 to Von Rosenberg, Jr.; and 3,844,733 to Donath. U.S. Pat. No. 4,415,431 issued to Matyas et al. shows use of char as a carbonaceous material to be mixed with oxygen and steam in a first-stage gasification zone to produce a synthesis gas. Synthesis gas, along with additional carbonaceous material, is then reacted in a second-stage hydropyrolysis zone wherein the additional carbonaceous material is coal to be hydropyrolyzed.

Reaction Quench

One method of terminating the volatilization reaction is by quenching the products either directly with a liquid or gas, or by use of a mechanical heat exchanger. In some cases, product gases or product oil are used. Many reactors, including those for gasification have employed a quench to terminate the volatilization reaction and prevent polymerizing of unsaturated hydrocarbons and/or gasification of hydrocarbon products. Some have employed intricate heat-exchange quenches, for example, mechanical devices to attempt to capture the heat of reaction. One such quench scheme is shown in U.S. Pat. No. 4,597,776 issued to Ullman et al. The problem with these mechanical quench schemes is that they introduce mechanical heat-exchanger apparatus into the reaction zone. This can cause tar and char accumulation on the heat-exchanger devices, thereby fouling the heat exchanger.

It would be highly advantageous to have an easy, efficient, environmentally sound method of refining coal using no external water to produce a slate of clean burning, nonpolluting co-products including benzene, toluene, xylene (BTX); ammonia; sulfur; naphtha; and methanol as well as a clean burning boiler fuel which is: (1) transportable using existing oil pipeline, tanker car and tankership systems; (2) burnable either directly as a substitute for oil in existing coal- or oil-fired combustion systems with little or no equipment modification, or separable at the destination to provide a liquid hydrocarbon fuel or feedstock and a burnable char; (3) a uniform combustion product regardless of the region from which the coal is obtained; (4) high in BTU content per unit weight and volume; (5) low in ash, sulfur and nitrogen; and (6) high in solid loading and stability.

Further, it would be highly advantageous to have a system for refining coal wherein short residence times and internally generated hydrogen are used at milder conditions to efficiently produce large quantities of hydrocarbon liquids without excess gasification of such products by high temperatures and high partial pressures of hydrogen. In this manner, hydrogen in the coal could be preserved and utilized to increase the value of the co-products.

Further, it would be highly advantageous to have a system for refining coal wherein a very high percentage of the coal carbon was volatilized, minimizing char formation, yet liquid yields were maximized with reduced formation of gas. In prior art processes, higher volatilization temperatures associated with higher carbon conversions tended to hydrocrack hydrocarbon fractions to lighter gases, thus reducing the oil yield. Attempts to preserve volatilized material as oil required reduction of volatilization temperatures and/or residence times which adversely affected carbon conversions.

SUMMARY OF THE INVENTION

The instant invention relates to an improved method for refining coal by short residence time hydrodisproportionation using thermal hydrocracking techniques with selective condensation to maximize conversion of coal carbon to volatile products while maximizing yields of lighter oil fractions and minimizing gas formation.

It has now been unexpectedly discovered that short residence time hydrodisproportionation processes employing thermal hydrocracking can be carried out at lower hydrogen partial pressures and higher volatilization temperatures to effect higher heating rates to maximize devolatilization (minimize char formation) without attendant gas production. Thus, by selecting reaction conditions in accordance with the invention, carbon conversions can be maximized to reduce char formation and increase yields of particular lighter hydrocarbon liquids ($C_5$ to $C_{20}$), a process result heretofore not thought attainable.

In accordance with the invention, particles of volatile-containing carbonaceous material are heated at a rate effective to rapidly decompose (crack) and devolatilize the solid, organic material in the presence of a reducing atmosphere which selectively promotes condensation of cracked volatilization products to liquid products prior to hydrostabilization of the volatilized material by hydrogenation. The decomposition reaction volatilizes the solid organic material into hydrocarbon vapor, causing it to "exit" the carbonaceous particle. The volatilized material is thermally hydrocracked to hydrocarbon fragments and free radicals which are contacted with a reducing atmosphere at a condensation temperature wherein the reducing atmosphere has a partial pressure of hydrogen effective to selectively promote condensation reaction of free radicals prior to hydrostabilization. In this manner, higher heat rates and volatilization temperatures can be used to effect high carbon conversion to volatiles, since hydrocracked fragments which would otherwise go to gas are allowed to selectively condense to lighter oil fractions prior to "capping" the free radicals with hydrogen to hydrostabilize the volatilization product. This condensation step, which can be carried out together with the hydrogenation in a single condensation/hydrogenation step or upstream therefrom in a separate condensation step, employs a moderate hydrogen partial pressure, preferably in the presence of methane gas to inhibit gas formation, which is effective to selectively promote certain condensation reactions of the fragments and free radical to produce lighter liquid hydrocarbons (oil). The concentration of hydrogen is sufficient to provide hydrostabilization to prevent the heavy tar formation typical of prior art pyrolysis processes but not so great as to promote gas formation. As set out in the prior art, higher hydrogen partial pressures tend to inhibit condensation reactions and thereby produce large amounts of gas at higher volatilization temperatures and/or longer residence times. This gas production, especially in very reactive coals and lignites, is not preferred for a hydrocarbon liquid driven fuel system in that it uses up large amounts of valuable hydrogen without producing products which have a high selling price ($/MMBtu). Thus, it has been unexpectedly found that in accordance with the instant invention, the temperature, hydrogen partial pressure, and residence time can be controlled to maximize carbon conversion to stable, high quality lighter hydrocarbon liquids while minimizing gas production as well as heavy tar formation by selectively condensing lighter volatilization products to lighter oils prior to hydrostabilization of the selectively condensed volatilization products.

The present process involves an improved method for refining a volatile containing carbonaceous material by thermal hydrocracking using selective condensation to produce a slate of hydrocarbon-containing products by short residence time hydrodisproportionation. The process contemplates a heating step wherein volatile-containing carbonaceous particles are rapidly heated in a reducing atmosphere at a rate effective to maximize decomposition and minimize the formation of char to volatilization temperatures effective to produce decomposed and volatilized product. The decomposed product is contacted at condensation temperatures effective to promote selective condensation with a reducing atmosphere which contains a hydrogen partial pressure lean enough to allow selective condensation, yet sufficient to effect hydrostabilization of the condensation reaction products to yield predominantly liquid boiling range hydrocarbons (from about $C_5$ to about $C_{20}$). The condensation reactions and hydrogenation reactions are accomplished at residence times effective to maximize hydrostabilized liquid hydrocarbon production. The hydrostabilized condensation reaction material can then be quenched to a final stabilization temperature below the reaction temperature to prevent deterioration of light liquid products to heavy liquids (tar).

The heating rate in the heating step is such that the decomposition reaction rate is optimized. Contacting the volatilized material with a reducing, hydrogen-containing atmosphere is carried out at conditions such that the decomposed volatiles undergo first selective condensation reactions and then hydrostabilization reactions to maximize liquid hydrocarbon production.

In a preferred embodiment, the hydrogen-containing gaseous atmosphere is obtained in substantial part from the carbonaceous material. In accordance with a further preferred embodiment, the partially hydrogenated condensation reaction material is quenched to effect final stabilization, i.e., prevent further condensation reactions to heavy hydrocarbons.

Preferably, the quench medium, which can comprise water and light recycle oil recovered from the stabilized hydrocarbon material, is used to reduce the temperature of the reactor effluent to final stabilization temperatures. In a greatly preferred embodiment, a partial oxidation reactor is used to produce the heat for volatilization/decomposition and to provide the hydrogen-containing reducing atmosphere.

In another embodiment, a catalyst is injected with the carbonaceous material effective in promoting selective condensation reactions to lighter and medium boiling range liquid hydrocarbons.

In a greatly preferred embodiment, the instant inventive process is carried out in three distinct steps. In a first step, the carbonaceous volatile-containing matter is heated at a decomposition/devolatilization heat rate in a hydrogen-lean reducing atmosphere to a volatilization temperature effective to minimize formation of char and maximize the amount of volatilized material. In a second step, the decomposed hydrocarbon material is contacted with a hydrogen donor-lean medium for a condensation residence time to effect a selective condensation to particular lighter liquid hydrocarbons. In a third step, the reactor product containing the selectively condensed and partially hydrogenated hydrocarbon liquids is contacted with a hydrogen donor-rich reducing atmosphere for a hydrogenation residence time at a hydrogenation temperature effective to further hydrogenate and hydrostabilize the reaction products.

DESCRIPTION OF THE PREFERRED EMBODIMENT

Figure 1:
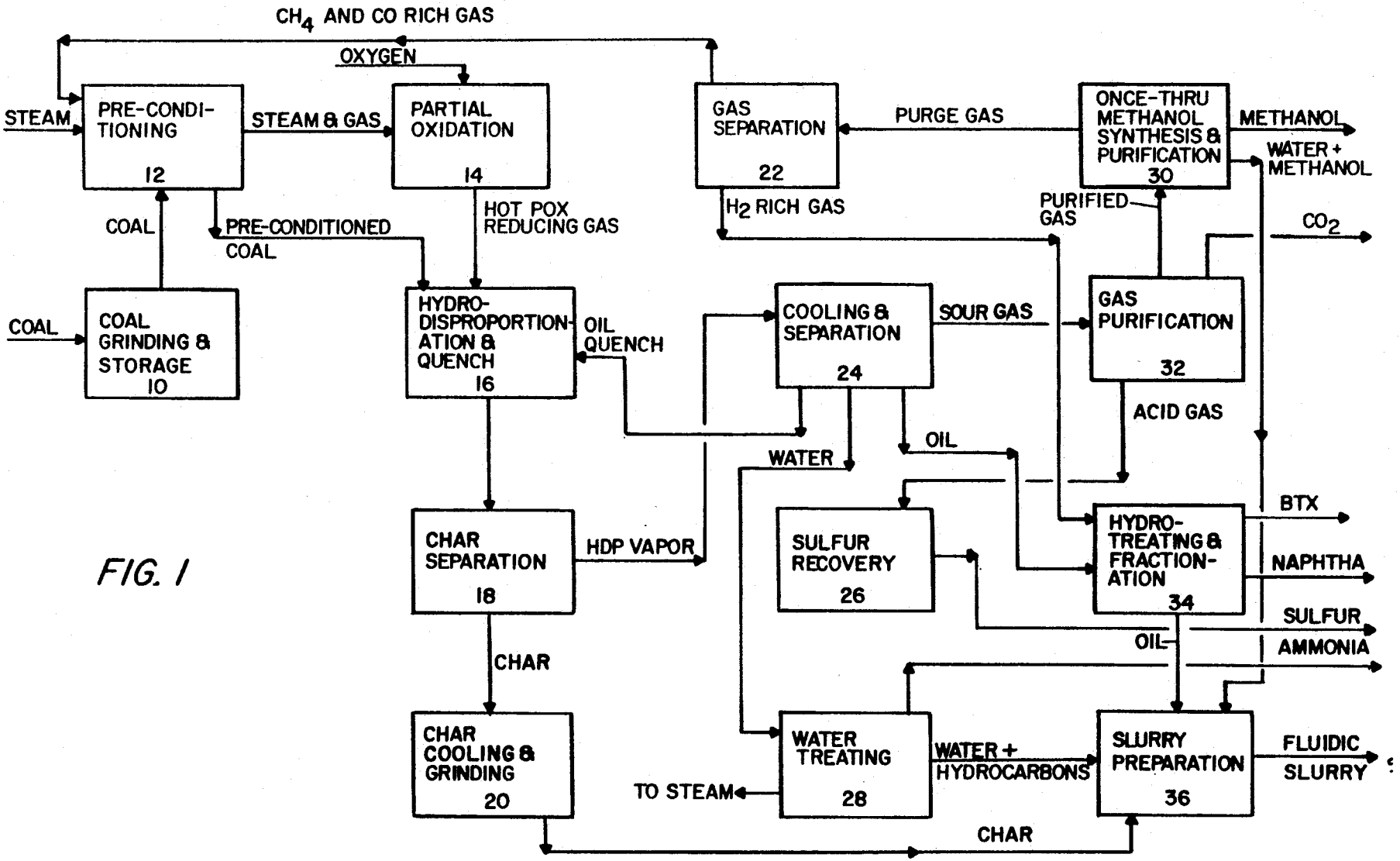
FIG. 1 is a flow sheet schematic for the coal hydrodisproportionation process of the present invention where numbered blocks refer to unit process steps and/or facilities as contemplated by the practice of the instant invention and described in the following specification.
Figure 2:
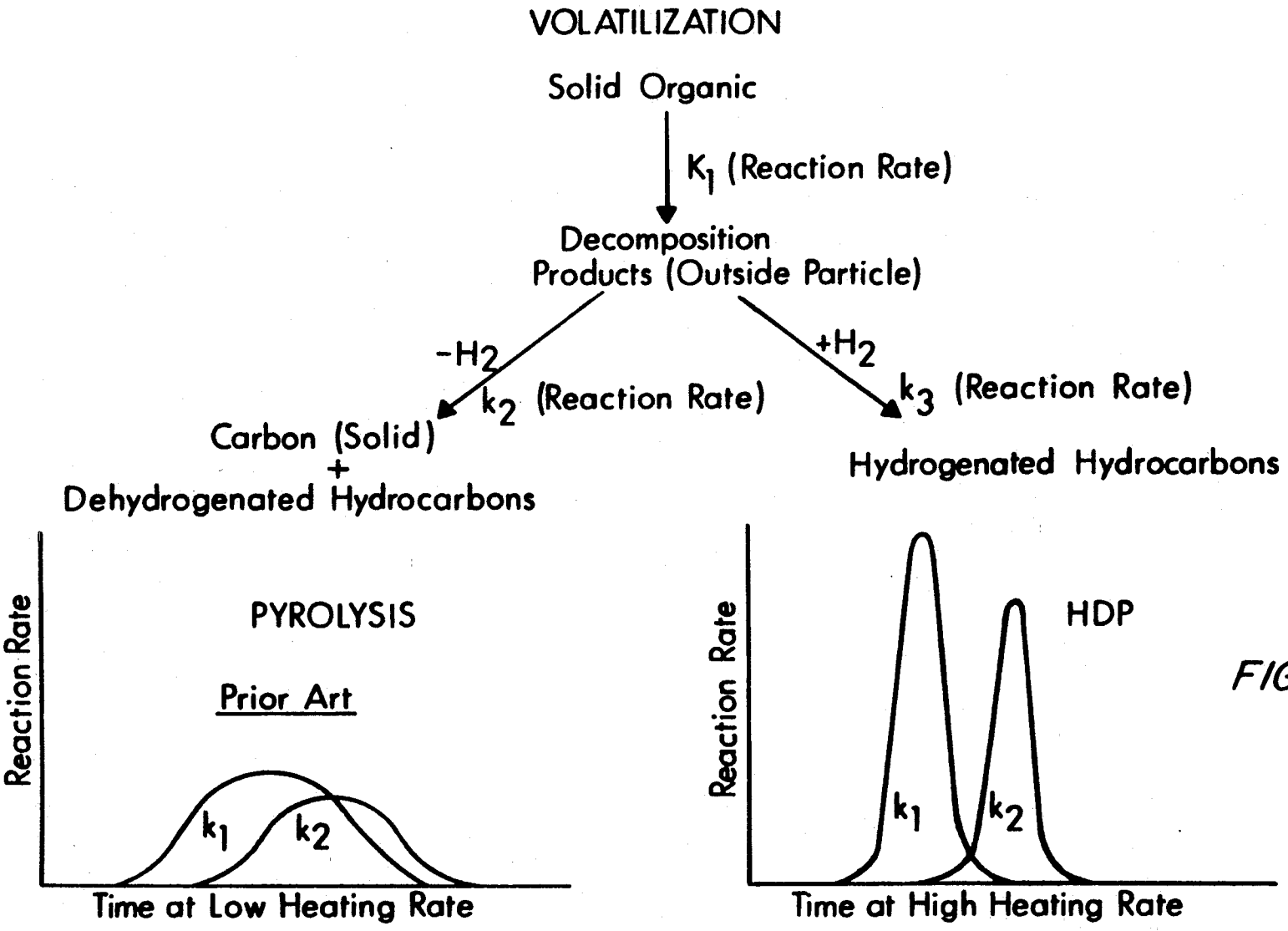
FIG. 2 is a depiction of the reaction rates and reactions associated with the prior art pyrolysis as well as those associated with the HDP reactions of the present invention.

The process of the instant invention commences with coal feedstock received at the plant battery limits. Referring to FIG. 1, the feedstock is conveyed to coal grinding unit 10 where the coal is reduced to size and partially dried, if necessary. The sized and partially dried coal is fed to a preconditioning unit 12 (optional) that preconditions and preheats the coal by direct contact with superheated steam and recycled gas from gas separator unit 22. Steam, recycled gas and oxygen from the air separation plant (not shown) are reacted as first stage reactions in partial oxidation (POX) unit 14 to produce a hydrogen-lean reducing gas at a high temperature (as later more fully described). The hot POX gas provides the heat, and moderate hydrogen partial pressure necessary for short residence time hydrodisproportionation (SRT-HDP) of the carbonaceous material in the SRT-HDP and quench unit 16 as well as the make-up hydrogen needed for hydrotreating the HDP liquids in the downstream hydrotreating and fractionation unit 34.

The pre-conditioned coal from unit 12 is contacted with the hot POX gas from unit 14 in an SRT-HDP and quench unit or fluidized hydrocracker 16. In the first section of the reactor, the coal is rapidly heated to decompose and devolatilize the coal to char and a decomposed volatilization product. In the second stage of the reactor, the volatilization product is rapidly quenched with recycle process oil to a condensation temperature where hydrocarbon fragments and free radicals selectively react to primarily light liquid hydrocarbons and are partially hydrogenated (hydrostabilized). In the third stage, the condensation and partially hydrogenated product is further quenched with a donor-rich hydrogen stream to promote further hydrogenation of the reaction products.

The residence time in the first stage of the reactor (devolatilization and thermal cracking) is from about 5 milliseconds to about 75 milliseconds, and preferably 15 milliseconds to 60 milliseconds, and most preferably 20 milliseconds to 40 milliseconds; at temperatures of from about 1500° F. to about 2000° F., and preferably 1700° F. to 2000° F. for bituminous coals and 1500° F. to 1750° F. for subbituminous coals and lignites. The hydrogen partial pressure in the devolatilization section is from about 50 psig to 200 psig, and preferably 75 psig to 125 psig.

In the second stage of the reactor (condensation and hydrostabilization), the temperature of the devolatilized and thermally cracked material is reduced to about 1100° F. to about 1300° F. Second stage residence times range from about 20 milliseconds to about 100 milliseconds, and preferably 30 milliseconds to 75 milliseconds, and most preferably 40 to 60 milliseconds. Hydrogen partial pressure in the second section is from about 50 psig to about 200 psig, and preferably 75 psig to 125 psig.

The condensation and partially hydrogenated product from the second stage of the reactor is further quenched to a temperature of from about 900° F. to about 1100° F. during third stage residence times of from about 100 milliseconds to about 2 seconds, and preferably 250 milliseconds to 1.5 seconds, and most preferably 500 milliseconds to 1 second. The hydrogen partial pressure in the third stage is from about 200 psig to about 600 psig, and preferably 250 psig to 500 psig, and most preferably 300 psig to 400 psig.

The char produced is separated from the condensation reaction products in the char separation unit 18 and most of the char is sent to cooling and grinding (sizing) unit 20. A small amount of the hot char is sent to a steam boiler, for example, a fluidized bed boiler (not shown), where it is combusted to produce steam required for preconditioning unit 12. The water to produce the steam is obtained from the water treatment unit 28. The cooled and sized char (32% minus 325 mesh) is mixed in slurry preparation unit 36 with hydrotreated process oil, methanol and an emulsifying amount of water to produce a non-polluting slurry fuel system which is a co-product of the instant invention.

The hot quenched condensation reaction vapor from unit 18 is cooled to recover heat and scrubbed to remove residual char dust in cooling and separation unit 24. The condensed oil and water are separated. The separated oil is sent to hydrotreating and fractionation unit 34.

The separated water is stripped in water treating unit 28 to remove dissolved gases and ammonia. Anhydrous ammonia is then recovered as a co-product and sent to storage (not shown). The stripped water is subjected to distillation in unit 28. The distillate water from the concentrator is used to produce steam in the steam boiler (not shown). The remaining water fraction, which is high in hydrocarbon content, is then moved to slurry preparation unit 36 for use as emulsifying water in the preparation of the fluidic fuel system. Thus, there is no discharge water effluent from the facility.

The non-condensed, cooled sour gas from unit 24, which has been scrubbed to remove char dust, is conveyed to the gas purification unit 32 where sulfur compounds, trace impurities and most of the carbon dioxide are removed. The removed sulfur components are sent to a sulfur recovery unit 26 where the sulfur is recovered by conventional means as a co-product and sent to storage (not shown). The separated $CO_2$ is compressed by conventional means to about 2,000 psia in unit 32 and removed by pipeline (not shown) as a coproduct for use in enhanced oil recovery, agriculture, and industry.

The purified gas from gas purification unit 32 is sent to a "once-through" methanol synthesis unit 30 where, on a single pass, part of the $H_2$, CO and $CO_2$ in the gas is catalytically converted to methanol and water. The crude methanol produced is purified in unit 30 by, for example, distillation, and pure methanol is separated and moved to storage (not shown). A high concentration of methanol in a water stream (up to 95% methanol by volume) is also separated and moved to the slurry preparation unit 36 for preparation of the fluidic fuel system. This stream negates the necessity for expensive methanol purification while providing a diluent and thermal $NO_x$ supressant to the fluidic fuel. Unreacted gases are purged from the methanol synthesis unit and moved to gas separation unit 22.

In gas separation unit 22, the purged gas from methanol synthesis is separated into two streams; a hydrogen rich gas and a methane-carbon monoxide-rich gas. The hydrogen rich gas is sent to hydrotreating and fractionation unit 34. The methane-carbon monoxide rich gas is preheated in the boiler (not shown) and then recycled to the pre-conditioner unit 12.

The oil from cooling and separation unit 24 is fractionated to separate naphtha (minus 380° F. boiling hydrocarbons) from hydrocarbons boiling above 380° F.

The separated naphtha, containing some BTX, is hydrotreated and the BTX is separated by extractive distillation in unit 34. The BTX and naphtha are removed to storage (not shown). The separated oil (380° F.+boiling hydrocarbons) is also hydrotreated in unit 34, then moved to unit 36 to be mixed with char to produce the slurry fuel. This hydrotreated oil has a heating value in excess of 18,000 Btu/lb and is substantially devoid of $SO_x$ and $NO_x$ producing compounds.

The carbonaceous materials that can be employed as feedstock in the instant process are, generally, any volatile-containing material which will undergo hydropyrolytic destructive distillation to form a particulate char and volatilization products. Bituminous and subbituminous coals of various ranks and waste coals, as well as lignite, are examples. Peat may also be used. Anthracite is not a preferred feedstock in that the volatiles are minimal. When coals having lower percentages of volatiles are used, alcohols or other "make-up" hydrocarbons must be added to the liquid organic fraction derived from hydrodisproportionation to produce the pipeline transportable compositions having desirable rheology characteristics.

Preferably, coal from the lignite rank to the medium volatile bituminous rank are used since these carbonaceous materials have sufficient volatiles so as to avoid the requirement for make-up hydrocarbons. Lignites are an advantageous starting material for the instant invention since they contain moisture (inherent water) for hydrodisproportionation and manufacture of methanol, as well as up to 55% by weight volatiles (on a dry basis). This is advantageous in producing char slurries having higher liquid content with lower viscosity liquids. Additionally, preconditioning of the coal, as disclosed herein, increases liquid yield and lowers the viscosity of such liquids. Its use with the instant invention is economically dependent and is predicated upon the rank of coal being refined.

The physical properties of the coal are also important in the practice of the present process. Coals of higher rank have plasticity and free swelling characteristics which tend to cause them to agglomerate and slake during the hydrodisproportionation process.

The mining and preparation of coal is fully described in Kirk-Othmer ENCYCLOPEDIA OF CHEMICAL TECHNOLOGY, second edition, Vol. 5, pp. 606–676. The coal is mined by either surface or underground methods as appropriate and well known in the art.

The raw coal, which preferably has a particle size of less than about 5 cm, is normally subjected to crushing to reduce the particle size. Preferably, the coal is pulverized to 70 percent minus 200 mesh. The need for size reduction and the size of the reduced material depends upon the process conditions to be used, as well as the composition and rank of the coal material, particularly its agglomerating tendencies and the need for beneficiation to reduce the inorganic sulfur and ash content of the coal. When beneficiation is necessary, the coal is preferably ground and subjected to washing and beneficiation techniques. When coals are used which have agglomerating tendencies, the size of the coal must be matched to the hydrodisproportionation techniques and process conditions in order to produce a particulate char and to prevent agglomeration during hydrocracking.

Coal Preparation

Referring to FIG. 1, unit 10 includes coal receiving, storage, reclaiming, conveying, grinding and drying facilities required to prepare the coal for introduction to the pretreatment unit 12. Unit 10 also includes facilities to grind or pulverize the feed coal from a received size of 5 cm to 70 percent minus 200 mesh and to dry the coal to from about 1% to 12% by weight moisture and preferably 2% to about 4% by weight moisture.

The crushing, pulverizing and/or grinding can be accomplished with any equipment known in the art, but preferably is accomplished with impact mills such as counter-rotating cage mills, hammer mills or the like. The pulverizers are swept with a stream of heated gas which partially dries the coal. Pulverizer outlet temperature is maintained at from about 100° to about 500° F. and preferably from 150° F. to about 400° F.

Coal Preconditioning

Unit 12 of FIG. 1 includes coal pre-conditioning with steam and methane/carbon monoxide ($CH_4$/CO) rich gas. The ground, partially dried coal is pneumatically conveyed to a set of cyclone separators located in coal preconditioner unit 12. Part of the transport gas from these cyclones is returned to the pulverizer circuits and the remainder of the gas is sent to a bag house prior to being vented to the atmosphere. Fugitive dust collectors are provided at transfer points to minimize coal dust emissions to the atmosphere. Advantageously, carbonaceous fines and the like are subjected directly to hydrodisproportionation.

The coal from the cyclone separators and bag filter is sent to a coal feed surge bin. The coal is normally fed through lockhoppers which are pressurized with nitrogen from the air separation plant. After an upper lockhopper is filled with coal, it is then pressurized prior to its discharging coal to the lower lockhopper. The emptied upper coal lockhopper is then depressurized to atmospheric pressure and is again filled with coal from the surge bin. Lockhopper valves are controlled, for example, by a microprocessor unit which is used to control the coal filling, pressurization, coal feeding and depressurization sequence.

The coal preconditioner unit 12 is preferably a fluidized bed vessel in which coal from the lockhoppers is contacted with $CH_4$/CO rich recycle gas and steam at from about 100 psig to about 600 psig, preferably in the range of about 250 psig to about 500 psig, at a temperature from about 600° F. to about 1,050°, preferably about 800° F. to about 1,000° F., and more preferably about 950° F. The coal is contacted with the heated gas and steam to provide mixed coal and gas temperatures at a temperature between about 350° F. and about 650° F. The exact temperature will depend upon the coal. Coking and agglomerating coals are especially sensitive to mixing temperatures. The residence time of the coal in the preconditioner varies from about 30 seconds to 3 minutes, preferably about 2 minutes, depending on the desired temperature, coal particle size distribution, rank of coal, and throughput rate. The velocity of the steam is preferably adjusted to suspend the coal particles in the steam (fluidized bed). The superheated steam and gas preheat and pre-condition the coal prior to the coal being fed to the SRT-HDP unit 16. Steam, gas, and entrained coal fines from the fluidized bed are fed to a separator, for example, an internal cyclone, where the coal is separated and returned to the fluidized bed while the resultant steam and gas stream, containing entrained hydrocarbon gas from the separator, is sent to partial oxidation (POX) unit 14. The preconditioned coal is moved to the HDP unit. Advantageously, the preconditioning is carried out using process heat from both the char and hot gases liberated during the HDP reaction.

Neither the preconditioning steam nor the entrained hydrocarbons are emitted into the air but, in fact, are used as a fuel source in the POX unit to increase heat and produce hydrogen, CO and the like. Preconditioning is optional depending upon the potential for increased liquid yield from a particular rank of coal versus the capital and operating costs of the preconditioning unit.

Partial Oxidation

Referring to FIG. 1, the POX unit 14 may comprise any pressurized partial oxidation vessel capable of producing synthesis gas ($H_2$ and CO) and high quality heat for the HDP reaction. In the POX unit, steam and methane-carbon monoxide-rich gas are sub-stoichiometrically reacted with oxygen to produce hydrogen and CO. The $CH_4$/CO-rich gas is preferably from the gas separation unit 22 discussed hereinbelow. The hydrogen, CO, and unreacted steam from the POX unit are at a high temperature and provide the required heat, hydrogen partial pressure, and reducing atmosphere necessary for hydrocracking the coal.

More specifically in the instant process, a fuel gas, preferably a CO-rich methane, and more preferably a purified reaction gas, is introduced into a pressurized vessel with oxygen. The oxygen is present in an amount less than the stoichiometric amount required to react with all of the fuel gas. An amount of steam sufficient to preferentially inhibit the production of water is also introduced. The steam is preferably derived from preconditioning the coal. The CO in the gas stream is preferred for the selective production of hydrogen by extraction of an oxygen from water. This occurs in accordance with one or more of the following reactions:

$$CH_4 + 1/2\,O_2 \longrightarrow CO + 2H_2$$

$$CH_4 + O_2 \longrightarrow CO_2 + 2H_2$$

$$CH_4 + H_2O \longrightarrow CO + 3H_2$$

Generally, the oxygen is introduced into the POX unit in an amount to provide a molar ratio of oxygen to $CH_4$/CO within a range from about 0.3 to about 1.25 and preferably from about 0.40 to about 0.90, and most preferably from about 0.5 to about 0.75 based on a volumetric ratio of methane-to-CO ratio of 1 to 1. These ratios will change depending upon the requirement for heat and the composition of the exit gas, specifically the required partial pressure of $H_2$.

The oxygen, fuel gas and steam are reacted in the POX unit at a pressure of from about 100 psig to about 1,200 psig and preferably from about 400 psig to about 800 psig and more preferably from about 500 psig to about 700 psig and a temperature within the range from about 2,000° F. to 3,000° F. and preferably from about 2,300° F. to about 2,600° F.

The partial oxidation reaction produces a hot gas stream principally comprising hydrogen, CO and steam along with carbon dioxide and minor amounts of other gases such as nitrogen or the like. The temperature within the POX unit is controlled such that the hot gas stream produced is essentially free (for example, totaling less than 0.1 volume percent of the total gas stream) of hydrocarbons, oxygen moities and hydroxymoities, although there can be a small amount of methane depending on the conditions. The hot gas stream is then injected into the HDP reactor.

Hydrodisproportionation and Quench

Coal from the preconditioner unit 12 is fed to the hydrodisproportionation and quench unit 16 ("HDP reactor" or "fluidized hydrocracker") by gravity and differential pressure. The coal is preferably injected into the HDP reactor through a central feed nozzle where it is rapidly heated by contacting with hot gas from the POX unit and volatilized at a thermal equilibrium mix temperature of from about 1,500° F. to about 2,000° F., and preferably at about 1,700° F. to 2,000° F. for bituminous coals and 1,500° F. to 1,750° F. for subbituminous coals and lignites at hydrogen partial pressures of from about 50 psig to about 200 psig. The hot POX gas rapidly heats the coal at a heating rate of at least about 10,000° F./second and at ranges from about 10,000° F./second to about 250,000° F./second, with the volatilized material undergoing condensation and hydrostabilization reactions.

In a preferred embodiment, the coal from preconditioning is mixed with a catalyst effective in selectively promoting condensation reactions to desired liquid hydrocarbon boiling ranges, i.e., gasoline boiling range, diesel oil boiling range, etc.

Prior to contacting the coal, the hot gas is accelerated to a velocity of from about 200 feet per second to about 1,000 feet per second, and preferably from about 300 feet per second to 800 feet per second, and most preferably from about 400 feet per second to 600 feet per second to effect mixing of solid and gas. This velocity effects intimate contact of the particulate coal with the hot gas stream and results in volatilization and thermal cracking of the coal within a residence time of from about 5 milliseconds to about 100 milliseconds, and preferably from about 15 milliseconds to about 60 milliseconds, with the most preferred residence time being 20 to 40 milliseconds.

The amount of particulate coal and the amount of hot gas introduced into the fluidized hydrocracker can be controlled to produce the desired reaction temperature and residence time. The volatilization products are rapidly cooled to effect the desired total hydrodisproportionation reaction exposure time.

The prior art injected oxygen into the volatilization reaction for heat; however, any oxygen present in the hydrocracking reaction of the instant invention is from oxygen in the coal molecule. The important aspect is that there is no "free" oxygen in the feed to the HDP reactor so that water formation is not the preferential reaction.

The outlet end of a POX reactor section is connected in close proximity to the inlet end of a hydrocracker section designed to accomplish the hydrocracking with selective condensation. The direction of flow of products through the POX unit and hydrocracker is not important since high velocity entrained flow is not gravity dependent. By using high velocity flows to propel the reaction products through the pressurized vessels, the direction of axial alignment of the vessels can be varied so long as the high rate of flow and exposure time required to achieve the desired product slate is provided. The direction of product movement through the reaction stages of HDP quench unit 16 is not limited to either upflow or downflow when a high velocity propelling force is used to overcome gravitational forces and to insure proper heating profiles and rapid product movement through the reactors.

The instant hydrodisproportionation process can be used for the hydrodisproportionation of any solid, semisolid or even liquid carbonaceous material which contains sufficient volatiles to permit the rearranging of internal hydrogen. Specifically, the amount of hydrogen that can be produced in this manner is finite. It has been found, however, that with most coals, except anthracite, devolatilization of the coal, selective condensation of gases, cracking of heavier material, and even hydrogenation of some portion of the solid carbon is possible. Of course, the more hydrogen in the feedstock, the more valuable is the slate of co-products produced.

As part of the HDP reactor configuration, an injector system is preferably used for rapidly admixing and heating the coal with a hot, hydrogen donor-lean stream of reducing gases. The coal injector can be centrally located or form a series of manifolded injectors dispersed on the inlet portion of the reactor. The carbonaceous material and hot gas are preferably injected through rectangular shaped slots with the hot gas stream injection angle not greater than 60 degrees when measured from a horizontal plane. The means for particle injection can be any means known in the art such as gravitational flow, differential pressure, entrained flow, or the like.

The following description of the proposed reaction sequence is advanced as explanatory theory only and should not be construed as a limitation on the instant invention. The rapid volatilization and decomposition of volatile containing carbonaceous material is accomplished by heating the carbonaceous material very rapidly to effect a high heating rate (second order function) to a volatilization temperature. When decomposition is accomplished at higher heating rates, i.e., in excess of 10,000° F., the decomposed volatilized material is "blown out" of the particle and hydrocracked to low molecular weight hydrocarbons containing free radical sites. If sufficient hydrogen (high hydrogen partial pressure) is present in the atmosphere, this hydrocracked material is rapidly hydrogenated to light hydrocarbons, predominantly methane and ethane gas.

However, by employing a relatively low hydrogen partial pressure and rapidly quenching to a condensation temperature with a quench medium low in hydrogen donor concentration or partial pressure, the decomposed, volatilized and hydrocracked material undergoes selective condensation reactions to produce primarily liquid hydrocarbons. In the presence of a lower hydrogen partial pressure and condensation temperature, the condensation reaction rate is promoted and production of liquid hydrocarbons is maximized.

The condensation reaction products, which may be partially hydrogenated, are further quenched with hydrogen to a hydrogenation temperature to further hydrogenate the selective condensation reaction products and to prevent further condensation to tars. Thus, in accordance with the instant invention, the initial heating rate of the coal does not have to determine the ultimate slate of volatilization products, including large amounts of gas, and the condensation reaction can be effectively controlled to maximize liquid hydrocarbon production.

Quench

The HDP vapor is subjected to a series of quenches to determine not only the residence time of specific stages, but also the reaction temperature and, in some cases, the partial pressure of hydrogen. The final quench ultimately stops all reactions. The direct quench system provides a direct heat exchange. Anterior of the HDP reactor vessel, disposed in an annular fashion about the circumference of the vessel, are one or more sets of quench nozzles through which a quench medium is dispensed. The initial quench is accomplished preferably with recycle process oil at a temperature of from about 100° F. to about 200° F. to effect a second stage condensation reaction temperature of from about 1100° F. to about 1300° F. and at a residence time of from about 25 milliseconds to about 100 milliseconds. The second quench is accomplished with a hydrogen donor-rich medium, preferably recycle hydrogen gas, at a temperature of from about 80° F. to about 300° F. to effect a third stage hydrogenation reaction temperature of from about 900° F. to 1100° F. and a residence time of from about 100 milliseconds to about 2 seconds. A final quench using an oil/water mixture at a temperature of from about 80° F. to 150° F. can be utilized to reduce the reaction product temperature to less than 700° F. and effectively terminate further reactions. This quench preferably includes recycle water and lighter oils to reduce the temperature of the HDP vapor to a stabilization temperature below about 700° F., essentially terminating condensation reactions.

In this quench process, there are no indirect (i.e., mechanical) heat exchangers. Rather, the heat required for the fractional distillation of hydrocarbon liquids is transferred directly by interaction of the quench media with the hot reaction vapor. Thus, no reheating is required and a "step down" distillation process is provided.

The quantity of quench medium is determined by its latent heat of vaporization and heat capacity or ability to absorb the sensible heat of the HDP vapors. The quench material can comprise any liquids or gases that can be blended rapidly and in sufficient quantity with the reactant mixture to readily cool the mixture below the effective reaction temperature. The cooling down or quenching of the HDP vapors can occur within the HDP reactor or subsequent to the departure of the gases from the HDP reactor. For example, the HDP vapors can be quenched in the pipe line between the HDP reactor and the char separator by quench nozzles located in the pipe line.

The short residence time in the HDP reactor is conducive to the formation of light and medium boiling range hydrocarbons. It has been found that rapid heating of carbonaceous materials not only "drives out" the volatiles from the feed particles (devolatilization), but also cracks larger hydrocarbons into smaller volatiles which escape from the host particle rapidly (decomposition). These cracked volatiles in a low hydrogen partial pressure atmosphere and condensation temperatures react rapidly with each other (condensation reactions) to form a less reactive liquid range hydrocarbon product. By lowering the internal energy of the condensation reaction products below the reactive energy level, maximization of lighter hydrocarbon liquids is obtained. By introducing methane gas in the reactor atmosphere upstream of the condensation step, gas formation is further thwarted.

The HDP reactor product slate includes primarily $H_2$, CO, $CO_2$, $H_2S$, $NH_3$, $H_2O$, and minus 700° F. boiling liquids, with lesser amounts of $C_1$ to $C_4$ hydrocarbons, benzene, toluene, and xylene, and plus 700° F. boiling liquids. The product slate is dependent upon the feedstock characteristics and operating parameters, such as hydrogen partial pressure, devolatilization and cracking temperature and residence time, condensation reaction temperature and residence time, and hydrogenation temperature and residence time, all of which can be varied within the reactor system. The concurrent presence of water vapor is required to inhibit the formation of water ($H_2+\frac{1}{2}O_2 \rightarrow H_2O$) and the net reaction extracts hydrogen from water to provide some of the hydrogen consumed in the hydrostabilization reactions. Hydrogen is extracted from water vapor in the partial oxidation unit to satisfy the hydrogen needs in the hydrocracker.

The total carbon conversion, expressed as the percentage of the carbon in the gases and liquids found in the hydrocracker end products to the total amount of carbon in the carbonaceous feed material ranges from about 40 weight percent to about 70 weight percent. The component carbon conversion expressed as the percentage of carbon converted to that component in the hydrocracker end product to the amount of carbon in the carbonaceous feed material ranges as follows: $C_1$–$C_4$ hydrocarbons from about 3 weight percent to about 10 weight percent; BTX from about 1 weight percent to about 5 weight percent; minus 700° F. boiling liquids (excluding BTX) from about 20 weight percent to about 40 weight percent; and plus 700° F. boiling liquids from about 0 weight percent to about 10 weight percent. Both carbon conversion and lighter liquid product yield are maximized by employing the selective condensation process of the instant invention.

The hydrocracker product gases are useful for the extraction of marketable by-products such as ammonia, as a hydrogen source for hydrotreating the product oil, as a fuel for use in combustion systems, and as a feedstock for the production of lower chain alcohols which can be used as a hydrocarbon-rich liquid to alter the viscosity of the slurry liquids and the flow characteristics of the slurry. In accordance with a preferred embodiment, these gases are used primarily to produce lower chain alcohols which are admixed with the liquid organic fraction. Advantageously, the gases are "sweetened" prior to being marketed or used in the process. The elimination of potential pollutants in this polluting fuel but also improves the economics of the process since the gaseous products may be captured and marketed or utilized in the process.

Char Separation

The quenched HDP vapor and char are sent to a primary char separator, unit 18 in FIG. 1, where most of the char is separated from the vapor. The vapor stream is then sent to a secondary separator to remove additional char. The vapor, now containing only a small amount of char dust, is conveyed to cooling and separation unit 24.

The separated char can then be fed to a lockhopper system for depressurization to atmospheric pressure. Char discharged from the lockhoppers is normally fed to char surge bins. The char from these storage bins can then be pneumatically conveyed with nitrogen to char cooling and grinding unit 20.

Char Cooling and Grinding (Sizing)

Char is preferably fed to facilities, unit 20 in FIG. 1, for cooling and sizing the char prior to mixing it with hydrotreated oil from hydrotreating and fractionation unit 34 to produce a fluidic fuel system. This char is normally cooled from about 700° F. to about 100° F. and can be pulverized to about 95% less than 325 mesh.

Part of the hot char from char cooling and grinding unit 20 is diverted to a boiler, for example, a fluidized bed boiler (not shown), to generate the steam required in preconditioning unit 12. The remainder of the char is cooled in a series of heat exchangers to about 520° F. by generating 600 psig steam also for use in preconditioning unit 12. The char is further cooled to 100° F. to 145° F. by cooling water in a second set of heat exchangers. The cooled char is sent to a separator where the char is separated from the carrier gas (nitrogen) before going to storage bins. (Nitrogen is a surplus by-product of oxygen manufacture). The cooled char is fed to nitrogen swept pulverizers. The pulverized char is pneumatically transported to a cyclone separator where it is separated from the nitrogen carrier gas. The separated nitrogen is sent to a bag filter to remove char dust prior to being vented to the atmosphere. Conveniently, conveyance of the char can be by pneumatic methods.

Slurry Fuel System Preparation

The pulverized char, hydrotreated oil, methanol and water are preferably mixed to produce a substantially combustible fluidic slurry fuel. Preferably, this fuel slurry is a three-phase system comprising solid char, hydrocarbons and an aqueous stream which may contain a portion of crude methanol to form an emulsion.

Cooled, pulverized char from char cooling and grinding unit 20 is fed to a pulverized char storage bin from which it is fed to a slurry mix tank where the char is mixed with hydrotreated oil from hydrotreating and fractionation unit 34, hydrocarbon-rich condensed water from the condensor in unit 28, and a methanol/-water mixture from methanol synthesis unit 30. The fluidic fuel slurry product from the mix tank is then pumped to storage (not shown).

Cooling and Separation (Fractional Condensation)

After the char dust is scrubbed from the HDP vapor in unit 19, the vapor is cooled and condensed. The facilities to accomplish this processing are represented in unit 24 of FIG. 1. Cooling and separation unit 24 accepts HDP vapor having a temperature of about 700° F. in four consecutive cooling steps. Liquid hydrocarbons and water are also condensed and collected for separation in an oil-water separator. Facilities are also available to scrub ammonia to less than 10 ppm in the gas before being sent to gas purification unit 32.

In a first cooling step, HDP vapor at about 700° F. from char separation unit 18 is cooled to about 520° F. in a heat exchanger. Saturated steam is generated in this exchanger. The partially cooled HDP vapor stream is sent to a scrubber and then to a vapor-liquid separator where condensed heavier hydrocarbons are separated from the cooled vapor stream. Part of the condensed liquid from the bottom of the separator is recirculated to the scrubber where it contacts the HDP vapor stream to remove residual entrained char dust from the HDP vapor. The remainder of the condensed heavy oil is further cooled to about 120° F. and recycled to the HDP reactor and quench unit 16 as the first-stage quench fluid. In a second cooling step, the HDP vapor at about 520° F. is circulated through a second heat exchanger where it is cooled to about 300° F. by generating lower temperature saturated steam. This cooled stream is moved to a second separator where condensed oil and water are separated from the vapor. The liquids are separated from each other in an oil-water separator in unit 24.

Vapor from the second separator is circulated through a third heat exchanger in a third cooling step where the vapor is further cooled to about 290° F. by preheating boiler feed water. The liquid-vapor stream then goes to a third separator for separation of the liquid from the vapor. The separated liquid stream (oil and water) is sent to an oil-water separator.

In a fourth cooling step, vapor from the third separator is sent to an air cooler where it is cooled to about 145° F. with air and then to about 100° F. by a water cooled exchanger.

The cooled vapor-liquid stream goes to a fourth separator (bottom section of the ammonia scrubber) where the light condensed oil and water are separated. The vapor then goes to a packed bed section in the ammonia scrubber where it is contacted with water to remove any remaining ammonia and hydrogen cyanide. Part of the condensed oil and water from the bottom of the ammonia scrubber is used as the final quench liquid for the hot HDP vapor produced in the SRT-HDP reactor. The remainder of the condensed light oil and water is sent to an oil-water separator within the cooling and separation unit 24.

The oil-water separator in unit 24 is designed to separate the condensed oil from water in the three oil/water streams and to provide intermediate storage of the separated oil and water streams.

The heavy oil-water stream from the second separation is cooled and sent to a heavy-oil expansion drum where the pressure is reduced and where most of the dissolved gases in the heavy oil-water mixture are released. The de-gassed heavy oil-water mixture is sent to a heavy oil separator where heavy oil is separated from lighter oil and water. The lighter oil and water are then sent to another oil-water separator where the light oil is separated from the water. The separated heavy oil and light oils are then sent to an oil run-down tank. Water from the bottom of the separator is sent to a sour water storage tank.

The medium oil-water stream from the third separator is cooled, then mixed with the light oil-water stream from the fourth separator and sent to a medium and light oil expansion drum. The released gas is mixed with the gas from the heavy oil expansion drum and then cooled to 105° F. in an water cooled heat exchanger. The oil-water mixture from the expansion drum is sent to a separator where the oil is separated from the water. Separated oil is sent to the oil run-down tank. The oil is then pumped to the hydrotreating and fractionation unit 34. Water from the bottom of the oil separator is sent to the sour water tank before being sent to unit 28 water treating.

The acid gas and ammonia are stripped from various process water streams and anhydrous ammonia with a purity of greater than 99.5 wt. percent is recovered. This unit also reclaims excess process water by utilizing a brine concentrator. Reclaimed water is re-used in the plant or admixed with the fluidic fuel in unit 36 slurry preparation as previously described. A useful water treatment/ammonia stripping and recovery section is the proprietary process licensed by United Engineers and Consultants (subsidiary of U.S. Steel).

Sour ammonia-containing water is sent to an ammonia still (steam stripper) where acid gas and free ammonia are stripped from the water. Stripped water from the bottom of the ammonia still is sent to a flash drum where a small amount of the water is flashed and recycled to the still. Remaining water from the flash drum is separated into two streams. One stream goes to a water cooled exchanger where the stripped water is cooled. The second stream is sent to a concentrator where dissolved solids and organics are concentrated and sent to slurry fuel system preparation unit 36.

The stripped ammonia and sulfur-containing acid gas from the ammonia still are sent to an ammonia absorber where the ammonia is selectively separated from the acid gas, utilizing, for example, a lean ammonium phosphate solution as the solvent. The acid gas from the absorber overhead is sent to the sulfur recovery unit 26, which may be, for example, a Claus unit. The anhydrous ammonia, after separation from the water, is condensed and pumped to storage (not shown).

Hydrotreating and Fractionation

Unit 34 represents a facility to hydrotreat, hydrodesulfurize and hydrodenitrofy naphtha and oil produced in the hydrodisproportionation of coal. This process renders these co-products substantially non-polluting, i.e., no $SO_x$ or fuel $NO_x$. This unit area is divided into three sections: a fractionation section, a naphtha hydrotreating/BTX recovery section, and an oil hydrotreating section. The recovered oil is first fractionated to separate naphtha boiling range hydrocarbons from heavier boiling range hydrocarbons.

The separated naphtha boiling range hydrocarbons are sent to the naphtha hydrotreating section where they are desulfurized and denitrified to less than 1 ppm and 0.1 ppm, respectively. A commercial grade BTX product is recovered along with a naphtha product, both of which are useful as gasoline blending stock and/or chemical feedstock.

The oil hydrotreating section hydrotreats and stabilizes the oil (hydrocarbons boiling above 380° F.) such that it will not polymerize, and desulfurizes the oil to less than 0.15 percent sulfur. The oil hydrotreater also reduces nitrogen to less than 2000 ppm and oxygen to less than 100 ppm. This process renders the fluidic fuel produced from this oil substantially free of fuel $NO_x$ and $SO_x$ pollutants in accordance with one aspect of the instant invention.

In a preferred embodiment, a process for further treating the liquid organic fraction to adjust viscosity is used. Processes for hydrotreating liquid hydrocarbons to reduce viscosity are known. A number of such technologies are readily available in the art. The paramount consideration in the present invention is to obtain a maximum amount of liquids having a viscosity consistent with producing a slurry that is capable of oil pipeline transport and of loading a maximum amount of a particulate solid char while being combustible in a liquid-fueled combustion system.

Gas Purification

All of the gas handling facilities required for gas purification are represented by unit 32 in FIG. 1. Gas purification unit 32 purifies sour gas from the cooling and separation unit 24. Sulfur components are removed to less than 0.2 ppm and carbon dioxide is reduced to about 3.0 percent so the resultant gas may be used in the methanol synthesis unit 30. Organic sulfur and trace quantities of ammonia and hydrogen cyanide are also removed from the gas. An example of such a commercially available gas purification unit is the "Rectisol" process licensed by Lurgi, Frankfurt, West Germany.

A compressor for carbon dioxide is included in unit 32. Carbon dioxide off-gas separated from the sour gas in gas purification unit 32 is sent to, for example, a two case, electric motor driven, centrifugal compressor where the $CO_2$ is compressed in 4 stages with air coolers followed by water cooled exchangers. An air aftercooler followed by a water cooler is also provided to cool the compressed (fluid) $CO_2$ to about 100° F. prior to being sent to a pipeline.

Sour gas from cooling and separation unit 24 is cooled by cool purified gas and refrigerant to condense residual water vapor in the gas. The condensed water is separated from the gas and sent to water treating unit 28.

The desulfurized gas then goes to a standard $CO_2$ absorber where most of the $CO_2$ is removed from the gas by, for example, cold solvent extractor. The cold, purified gas is heated by, for example, cross-exchange with the incoming sour gas prior to being sent to methanol synthesis and purification unit 30.

The solvent containing $H_2S$, COS and $CO_2$ from the $H_2S$ absorber is flashed to release dissolved gases ($H_2$, CO, $CH_4$, etc.). The solvent is further depressurized in a series of flashes to remove part of the dissolved $CO_2$. The enriched $H_2S$ solvent stream is sent to hot regeneration.

$CO_2$-rich solvent from the $CO_2$ absorber is flashed to release dissolved gases and is then further flashed to remove part of the dissolved $CO_2$. The partially regenerated solvent is recycled to the mid-section of the $CO_2$ absorber.

The released $CO_2$ from the $CO_2$ flash tower and from the $H_2S$ reabsorber are combined, heated and sent to the $CO_2$ compressor and then to a $CO_2$ pipeline. The $H_2S$-rich solvent from the $H_2S$ reabsorber is heated by cross exchange with hot regenerated solvent from the regenerator and then stripped in the hot regenerator to separate dissolved $H_2S$, COS, $CO_2$ and light hydrocarbons. The stripped gas is sent to sulfur recovery unit 26.

Gas Separation

Hydrogen is separated from purified HDP gases, which are primarily $CH_4$/CO (purge gas) in facilities represented by unit 22 of FIG. 1. Most of the separated hydrogen is recycled to the hydrocracker as second-stage quench medium. The remainder of the separated hydrogen is sent to hydrotreating and fractionation unit 34 for use in naphtha and oil hydrotreating. Most of the separated gas, primarily methane and carbon monoxide, is heated in the boiler (not shown) and sent to the preconditioning unit 12 prior to being partially oxygenated in the POX unit 14.

Purge gas from once-through methanol synthesis unit 30 is sent to a scrubber where any residual entrained solvent is removed by methods well known in the art.

The solvent should be removed from the gas or it will foul the membrane separator in gas separation unit 22. Gas from the scrubber is heated prior to going to the membrane separators. In the membrane separator, $H_2$ is separated from the other gases by semipermeable membranes formed, for example, into hollow fibers. The separated hydrogen (containing small amounts of $CO_2$, CO, and $CH_4$) is compressed in a hydrogen compressor. Most of the hydrogen-rich gas is recycled to the HDP reactor and used to quench the condensation reaction products to a hydrogenation temperature and to increase the hydrogen partial pressure. The remainder of the hydrogen-rich gas is sent to hydrotreating and fractionation unit 34. The separated gas, primarily $CH_4$ and CO, is heated and sent to the preconditioning unit 12.

Sulfur Recovery

Sulfur from the various sour gas streams produced in the plant is recovered by facilities represented as unit 26. Acid gas from gas purification unit 32 is sent to an $H_2S$ absorber where hydrogen sulfide and some of the carbon dioxide in the gas is absorbed using, for example, a SCOT solvent. The desulfurized gas, containing primarily light hydrocarbons, hydrogen and carbon dioxide are sent to the plant fuel gas header. The solvent from the absorber containing hydrogen sulfide and carbon dioxide is sent to a solvent stripper where the $H_2S$ and $CO_2$ are stripped from the solvent. The stripped acid gas is then sent to a reaction furnace. The $H_2S$ is converted to elemental sulfur by methods well known in the art. An example of such a device is a Claus unit. The sulfur produced is drained to a sulfur storage unit (not shown).

Once-Through Methanol Synthesis and Purification

Crude methanol is produced in a once-through reactor and purifies part of the crude methanol to meet Federal Grade AA specifications in accordance with another aspect of the instant invention. This area, represented by unit 30 of FIG. 1, also produces a methanol-rich water stream for mixing with the fluidic fuel to enhance rheological properties and reduce thermal $NO_x$ emissions. A portion of the methanol produced is mixed with the fluidic fuel. The remainder is used as an oxygenated motor fuel.

Purified gas from gas purification unit 32 is compressed to methanol synthesis pressure in, for example, a turbine driven synthesis gas compressor. Part of the compressed gas is cooled in, for example, a water cooled exchanger and sent to gas separation unit 22. The remainder of the gas is heated by cross exchange with the methanol reactor effluent gas and fed to the methanol reactor. In the reactor, part of the hydrogen reacts with carbon monoxide to produce methanol and a minor amount of hydrogen reacts with carbon dioxide to produce methanol and water. Only about 20% of the hydrogen fed to the methanol reactor is actually converted to methanol. The hydrogen is internally produced as set forth hereinbefore. Small amounts of organics and other alcohols are also produced in the reactor. The preferred reactor is an isothermal catalytic reactor. In accordance with this device, the gas flows through tubes containing a catalyst. The exothermic heat of reaction is removed by transferring heat to boiler feed water on the outside of the tubes and generating medium pressure steam.

The effluent gas and methanol from the reactor is partially cooled by preheating the feed gas to the reactor. The stream is further cooled by an air cooler and then a water cooler to condense the contained methanol and water. The non-condensible gas, primarily hydrogen, carbon monoxide and methane, with lesser amounts of carbon dioxide, ethane and nitrogen, is purged from the system and sent to unit 22 gas separation. In this process, there is no requirement to compress and recycle the purified gas to the methanol synthesis reactor. This eliminates the expensive compression and recycle steps required in typical methanol processes and, in effect, methanol is produced as an economical coproduct in the present process.

The condensed crude methanol, containing water, dissolved gases, and trace amounts of produced organics, is sent to a pressure let-down drum where part of the dissolved gases and light organics are released. The crude methanol is then sent to a stripper column where the remaining dissolved gases and light organics are stripped. The stripped crude methanol is then sent to a distillation column where pure methanol is recovered in the overhead, condensed and sent to storage. In a conventional process, essentially all of the methanol must be separated which makes it energy intensive and expensive. In this process, only part of the methanol is separated and the remaining methanol-rich water portion is used in the slurry preparation. A methanol-rich water stream is recovered in the bottom of the distillation column and sent to slurry preparation unit 36.

Slurry

The terms "slurry" or "liquid/solid mixture" as used herein are meant to include a composition having an amount of particulate char which is in excess of that amount which is inherently present in the liquid organic portion as a result of the hydropyrolysis process.

For most applications the particulate char constituent should comprise not less than about 45% by weight of the composition and preferably from about 45% to about 75% by weight. In accordance with one aspect wherein the char is separated from the liquid at the slurry destination, the term 'slurry' is intended to include a composition containing amounts of char as low as 1% by weight, which composition may be further transported, for example, by oil pipeline, to a refinery or to another combustion facility.

If the slurry is to be fired directly into a liquid fueled combustion device, the loading and the liquid organic constituents and the viscosity of the liquids may be varied to maximize combustion efficiency, and, in some cases, amounts of alcohol and "make up" hydrocarbon distillates can be added. This enhances combustion characteristics in a particular combustion system configuration and reduces thermal $NO_x$ as well as enhancing rheology characteristics of the slurry.

Liquid petroleum distillates which can be used include fractions from petroleum crudes or any artificially produced or naturally occurring hydrocarbon compound which is compatible with the coal-derived liquid organic hydrocarbon containing portion used as the slurry medium in accordance with the instant invention. These would include, without limitation, the aliphatic, cyclo-aliphatic and aromatic hydrocarbons, heterocyclics and phenols as well as multi-ring compounds, aliphatic-substituted aromatics and hydroxy-containing aliphatic-substituted aromatics. The term aliphatics is used herein to include both saturated and unsaturated compounds and their stereo-isomers. It is particularly preferred to add the lower chain alcohols, including the mono-, di- and trihydroxy compounds. Preferably, the make-up hydrocarbons do not contain mercaptal, sulfate, sulfite, nitrate, nitrite or ammonia groups.

Preferably, the chars are discrete spherical particles which typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and pass 100 mesh, and preferably 200 mesh. Similar chars are described in U.S. Pat. No. 4,702,747. The useful chars have a high reactivity and surface area, providing excellent Btu to weight ratios. They are particulate in nature as distinguished from the larger, "structured" particles of the prior art. The char particles are sufficiently porous to facilitate beneficiation and combustion but the pore size is not so large as to require the use of excessive liquid for a given amount of solid.

The char may be efficaciously sized and beneficiated. It is important, in order to obtain the requisite liquid/-solid mixture having the desired rheological characteristics, that the solid component be discrete, particulate char. The spherical shape of the char particles allows adjacent particles to "roll over" one another, thereby improving slurry rheology and enhancing the solid loading characteristics. When utilizing agglomerating or "caking" coals, preferably the process parameters are regulated so as not to produce an agglomerated product as previously set forth herein.

The char may be beneficiated. When beneficiation is indicated because of the inorganics present, beneficiation may be utilized to clean either the coal or the char. The beneficiation can be performed by any device known in the art utilized to extract pollutants and other undesirable inorganics such as sulfur and ash. The char has a high degree of porosity which enables it to be readily beneficiated. Beneficiation may be accomplished, for example, by washing, jigging, extraction, oil agglomeration (for coal only), and/or electrostatic separation. The latter three methods remove both ash and pyritic (inorganic) sulfur. When the solvent extraction or oil agglomeration methods are used, it is most advantageous to use, as the beneficiating agent, the liquid derived from the hydropyrolysis process. The exact method employed will depend largely on the coal utilized in forming the char, the conditions of hydropyrolysis, and the char size and porosity. The char material is ground to yield the substantially spherical, properly sized particulate coal char. Any conventional crushing and grinding means, wet or dry, may be employed. This would include ball grinders, roll grinders, rod mills, pebble mills, and the like. Advantageously, the particles are sized and recycled to produce a desired distribution. The char particles are of sufficient fineness to pass a 100 mesh screen (Tyler Standard) and about 32% of the particles pass a 325 mesh screen. In accordance with the instant invention, char particles in the 100 mesh range or less are preferable. It will be realized that the particulate char of the instant invention having particle sizes in the above range is important to assure not only that the solid is high in reactivity, but also that the slurry is stable and can be pumped as a fluidic fuel directly into combustion systems.

The exact distribution of particle sizes is somewhat empirical in nature and depends upon the characteristics of the liquid organic fraction. The rheological characteristics of the slurry are interdependent upon the viscosity of the slurry liquid and the particle size distribution of the char.

The ground, beneficiated char can be sized by any apparatus known in the art for separating particles of a size on the order of 100 mesh or less. Economically, screens or sieves are utilized; however, cyclone separators or the like can also be employed. The spheroid shape of the primary particle provides spacing or voids between adjacent particles which can be filled by a distribution of second or third finer particle sizes to provide bimodal or trimodal packing. This modal packing technique allows addition of other solid fuel material such as coal to the slurry without affecting the very advantageous rheology characteristics of the particulate char/liquid organic fraction slurry of the instant invention. Additionally, this packing mode allows the compaction of substantially more fuel in a given volume of fuel mixture while still retaining good fluidity.

Particulate char produced from certain ranks of coal has pore sizes and absorption characteristics such as to require treating of the char prior to slurrying of the particulate char with the liquid to reduce absorption by the char of the liquid phase. Prevention of excessive absorption of slurry liquid by the char is necessary to prevent instability of rheology characteristics. When absorption rates by the char are in excess of from about 10% to about 15%, pretreatment is very beneficial. In accordance with this pretreatment, the char is brought into intimate contact with an amount of the coating or "sealing" material effective to reduce the absorption of liquid by the char. The treatment is effected prior to the particulate char being slurried with the liquid. The sealants or coatings that are useful include organic and inorganic materials which will not produce pollutants upon combustion nor cause polymerization of the liquid slurry. Since surfactants and emulsifiers are used to enhance slurry stability, care must be taken that the coating or sealant is compatible with the stabilized composition. Sealants and coating materials which are particularly advantageous include parafins and waxes, as well as the longer chain aliphatics, aromatics, polycyclic aromatics, aro-aliphatics and the like. Mixtures of various hydrocarbons, such as No. 6 fuel oil, are particularly desirable because of their ready availability and ease of application. Advantageously, the higher boiling liquid organic fractions from the hydrocracking of the coal are utilized. The sealant or coating can be applied to the char by spraying, electrostatic deposition or the like. In this manner, the rheological stability of the slurry can be enhanced.

Coal and water, or more preferably the HDP gases, can be used to produce methanol and other lower chain alcohols, preferably in accordance with the method previously described. These alcohols are utilized as the liquid phase for the combustible fuel admixture to adjust liquid viscosity and enhance slurry rheology characteristics.

As used herein the term alcohol is employed to mean alcohols (mono-, di- and trihydroxy) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from the HDP process or natural gas. Advantageously, the alcohol constituent can be produced on site at the mine in conjunction with the HDP reaction.

The slurrying of the solid particles with the liquid can be accomplished by any well-known mixing apparatus in which an organic liquid constituent and a particulate char can be mixed together in specific proportion and pumped to a storage tank. Advantageously, emulsifying techniques are used, such as high speed impellers and the like. The method of slurrying, and especially emulsifying, will vary the rheology characteristics of the slurry. Unlike coal/water slurries and coal/oil mixtures, the fuel of the instant invention is transportable by oil pipeline and therefore does not require slurrying equipment at the end-use facility. Thus, even small process heat systems can utilize the fuel of the instant invention efficiently and economically.

The important rheological aspect of the slurry in the instant application is that it is pumpable and stable. This is accomplished by matching the size of the solid char particle, the viscosity of the liquid phase and the stabilizer. Preferably, a small percentage by weight, for example from 1% to about 12%, of water is admixed into the slurry. This is especially preferable when surfactants which have hydrophyllic moieties are used. The slurry is preferably agitated or blended to produce a suspensoid which is stable under shear stress, such as pumping through a pipeline.

As discussed above, surfactants, suspension agents, organic constituents and the like may be added depending on the particular application. Certain well-known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, zanthum gum, hydroxyethyl cellulose, carboxymethyl cellulose, polyvinyl alcohol and polyacrylamide. As hereinbefore mentioned, advantageously the admixture of the instant invention demonstrates high fluidity. Thus a high Btu per unit volume mixture is obtained with lower viscosities and higher fluidities. Certain of the well-known stabilizers create adverse rheological characteristics. Although no fixed rule can be set, those substances which tend to form gelatinous mixtures tend to cause dilitant behavior.

As previously set forth, the sizing and packing of the solid is particularly important in obtaining a highly loaded, stable, transportable combustion fuel system. It has been found advantageous to have the solid material smaller than about 100 mesh (Tyler) and about 32% passing a mesh size in the range of 325. Preferably, the viscosity of the liquid organic fraction is in the range of from 17° API to about 20° API. This will, of course, depend on the loading and pumping characteristics desired, the stabilizers used, and whether coal and/or alcohol are present in the slurry in accordance with the instant invention. The degree API is very important in the end-use application, i.e., the combustion system design. Those oil fired systems designed for "heavier" crudes will tolerate more viscious oils and higher loaded slurries.

Pollution Control

As previously stated, the fluidic fuel of the instant invention provides precombustion, elimination of pollution causing materials, specifically those which produce $SO_x$ and $NO_x$ upon combustion. The coal and/or the char may be beneficiated to remove pyritic sulfur. Organic fuel nitrogen and organic fuel sulfur are removed during the HDP reaction and further in the hydrotreating and fractionation unit 34.

Methanol can be added to the fluidic fuel as previously described in order to reduce the combustion (thermal) $NO_x$ by reducing the combustion temperature of the slurry. This, along with the uniformity of the fuel and the reactivity of char, greatly reduces the thermal $NO_x$ which is created by non-uniformity of coal which burns with hot spots.

A pulverized or powderized limestone can be added directly to the slurry highly in excess of stoichiometric amounts to act as a reactant in the combustion of the slurry to reduce the $SO_x$ emissions from pyritic sulfur.

While the invention has been explained in relation to its preferred embodiment, it is understood that various modifications thereof will become apparent to those skilled in the art upon reading the specification and the invention is intended to cover such modifications as fall within the scope of the appended claims.

What is claimed:

1. An improved method for refining a volatile containing carbonaceous material comprising the steps of:

(a) heating a particulate volatile containing carbonaceous material at a heat rate sufficient to maximize decomposition and minimize formation of char to a volatilization temperature effective to produce a substantially decomposed volatilization product; and (b) contacting said substantially decomposed volatilization product with a hydrogen donor-lean gaseous atmosphere at a condensation/hydrostabilization temperature effective to selectively form lighter liquid hydrocarbon condensation products and hydrostabilize said volatilization product containing said lighter liquid hydrocarbon condensation products for a condensation/hydrostabilization residence time effective to maximize liquid yield and minimize gas formation to produce a hydrostabilized, light liquid hydrocarbon condensation product containing volatilization product.

2. The method of claim 1 wherein said gaseous atmosphere contains a partial pressure of methane effective to retard methane formation.

3. The method of claim 1 comprising the further step of producing stabilized hydrostabilized volatilization product by adjusting the temperature of said hydrostabilized volatilization product to a stabilization temperature effective to substantially terminate formation of condensation products and thermal cracking of said hydrostabilized volatilization product.

4. The method of claim 1 wherein said heating rate is at least about 10,000° F. per second and said volatilization temperature is from about 1,500° F. to about 2,000° F.

5. The method of claim 1 wherein said condensation/hydrostabilization temperature is from about 900° F. to 1,300° F. and said condensation/hydrostabilization residence time is from about 0.020 seconds to 2 seconds and wherein said hydrogen donor-lean gaseous atmosphere contains from about 200 psig to about 600 psig partial pressure of hydrogen.

6. The method of claim 3 wherein said stabilization temperature is below about 700° F.

7. The method of claim 5 wherein said condensation/hydrostabilization temperature is effected by direct quench.

8. The method of claim 1 wherein said hydrogen donor-lean gaseous atmosphere is obtained in substantial part from said carbonaceous material and wherein said hydrogen donor-lean gaseous atmosphere and said volatilizing temperatures are produced in substantial part in a partial oxidation reaction wherein steam and hydrodisproportionation recycle gas rich in methane and carbon monoxide are reacted with a substoichiometric amount of oxygen.

9. The method of claim 1 wherein said carbonaceous material is selected from a group consisting of coals, lignites, low rank and waste coals, peats, and mixtures thereof.

10. An improved method for refining a volatile containing carbonaceous material comprising the steps of:

(a) heating a particulate volatile containing carbonaceous material by admixing said particulate with a gaseous heating medium at a volatilization temperature of from about 1,500° F. to 2,000° F. and at a decomposing heat rate of at least 10,000° F. per second to produce a substantially decomposed volatilization product;

(b) contacting said substantially decomposed volatilization product with a hydrogen donor-lean reducing gaseous atmosphere at a hydrogen partial pressure of from about 50 psig to about 200 psig at condensation temperatures of about 1,100° F. to about 1,300° F. and at a condensation reaction residence time of from about 0.020 seconds to about 0.10 seconds to produce a selective condensation hydrocarbon liquid containing reaction product, said hydrogen being formed in substantial part in a partial oxidation reaction wherein steam and a hydrodisproportionation recycle gas rich in methane and carbon monoxide are reacted with a substoichiometric amount of oxygen; and (c) contacting said selective condensation hydrocarbon liquid containing reaction product with a hydrogen donor-rich atmosphere having a hydrogen partial pressure of from about 200 psig to about 600 psig to hydrostabilize said reaction product at hydrostabilization temperatures of from 900° F. to about 1,100° F. and at hydrostabilization residence times of from about 0.10 seconds to about 2 seconds.

11. The method of claim 10 wherein the temperatures in both said contacting steps are effected by direct quench.

12. The method of claim 10 wherein said hydrogen in said hydrogen donor-lean and said hydrogen donor-rich reducing gaseous atmospheres is obtained in substantial part from said carbonaceous material.

13. The method of claim 10 wherein said carbonaceous material is selected from a group consisting of coals, lignites, low rank and waste coals, peats, and mixtures thereof.

14. The method of claim 10 wherein said partial oxidation reaction is carried out at temperatures of from about 2,000° F. to about 3,000° F. and at pressures of from about 300 psig to 700 psig, with a mole equivalent of oxygen to $CH_4/CO$ of from about 0.5 to about 0.75.

15. An improved method for refining a volatile containing coal to produce a slate of hydrocarbon containing coproducts by short residence time hydrodisproportionation comprising the steps of:

(a) contacting a particulate coal with a hydrogen donor-lean reducing gaseous mixture having a hydrogen partial pressure of from about 50 psig to about 200 psig and a methane partial pressure of from about 50 psig to about 400 psig, at a temperature in the range of about 2,000° F. to about 3,000° F. to heat said particulate coal at a volatilization temperature of from about 1,500° F. to about 2,000° F. at a heating rate greater than about 10,000° F. per second at pressures of from about 100 psig to about 1,200 psig for a time of from about 0.005 seconds to about 0.075 seconds to produce a substantially decomposed volatilization product, wherein said hydrogen donor-lean reducing gaseous mixture is obtained in substantial part from said carbonaceous material by a partial oxidation reaction wherein steam and hydrodisproportionation recycle gas rich in methane and carbon monoxide are reacted with a sub-stoichiometric amount of oxygen;

(b) cooling said substantially decomposed volatilization product to a condensation temperature from about 1,100° F. to about 1,300° F. for residence times of from about 0.020 seconds to about 0.10 seconds in an atmosphere having a hydrogen partial pressure of from about 50 psig to about 200 psig to produce a selectively condensed volatilization product, wherein said cooling is effected by direct partial quench by using a heavy hydrocarbon process liquid, or a heavy hydrocarbon process liquid which has been thermally cracked to produce lighter process liquids during said partial quench or mixtures thereof;

(c) contacting said condensation reaction product with a hydrogen donor-rich atmosphere having a hydrogen partial pressure of from about 200 psig to about 600 psig at hydrostabilization temperature of from about 900° F. to about 1,100° F. for a hydrostabilizing residence time of from about 0.10 seconds to about 2 seconds to produce a hydrostabilized reaction product; and (d) stabilizing said hydrostabilized reaction product at a temperature of less than about 700° F. to produce a hydrostabilized, selectively condensed volatilization product wherein said stabilization is accomplished by contacting the hydrogenated volatilization product with a mixture of water and lighter oils, said mixture being recycled from said hydrodisproportionation process.

16. The method of claim 15 wherein the first contacting step is accomplished at a volatilization temperature of from about 1,600° F. to about 1,800° F. and a heating rate greater than about 50,000° F. per second and a residence time of from about 0.005 seconds to about 0.050 seconds.

17. The method of claim 15 wherein said cooling step is accomplished at temperatures of from about 1,100° F. to about 1,300° F. and residence time of from about 0.020 seconds to about 0.1 seconds.

18. The method of claim 15 wherein said stabilizing step is accomplished at temperatures less than about 700° F.

19. The method of claim 15 wherein said partial oxidation reaction is carried out at temperatures of from about 2,000° F. to about 2,600° F. and pressure of from about 300 psig to about 700 psig with a mole equivalent of oxygen to $CH_4/CO$ of from about 0.5 to about 0.75.

20. The method of claim 15 wherein prior to said contacting step, the particulate coal is first subjected to preconditioning wherein the carbonaceous material is contacted with $CH_4/CO$ rich recycle gas and superheated steam at from about 100 psig to about 1,200 psig at a coal/gas/steam mix temperature of from about 450° F. to about 650° F. at residence times of from about 30 seconds to about 3 minutes.

* * * * *